US007481084B1

(12) United States Patent
Wu

(10) Patent No.: US 7,481,084 B1
(45) Date of Patent: Jan. 27, 2009

(54) FOLDABLE LOCK STRUCTURE

(76) Inventor: Chun-Hsien Wu, No. 717, Sec. 1, An Zhong Rd., Tainan (TW)

( * ) Notice: Subject to any disclaimer, the term of this patent is extended or adjusted under 35 U.S.C. 154(b) by 0 days.

(21) Appl. No.: 12/099,363

(22) Filed: Apr. 8, 2008

(51) Int. Cl.
*E05B 17/18* (2006.01)
*E05B 67/02* (2006.01)

(52) U.S. Cl. ..... 70/18; 70/38 C; 70/43; 70/49; 70/52; 70/53; 70/423; 70/455

(58) Field of Classification Search ..... 70/14, 70/18, 36, 38 C, 43, 49–56, DIG. 43, DIG. 56, 70/423, 424, 427, 428, 455
See application file for complete search history.

(56) References Cited

U.S. PATENT DOCUMENTS 1,718,723 A * 6/1929 Williams ..... 70/38 A
3,835,675 A * 9/1974 Lippisch ..... 70/38 A
5,092,142 A * 3/1992 Zane et al. ..... 70/39
5,230,231 A * 7/1993 Liou ..... 70/38 A
5,475,993 A * 12/1995 Kuo ..... 70/18
5,640,861 A * 6/1997 Chen ..... 70/38 A
5,713,224 A * 2/1998 Liou ..... 70/34
5,791,169 A * 8/1998 Kuo ..... 70/26
5,913,906 A * 6/1999 Strocchi ..... 70/18
5,987,940 A * 11/1999 Chang ..... 70/38 A
6,101,852 A * 8/2000 Steinbach ..... 70/38 A
6,263,711 B1 * 7/2001 Kuo ..... 70/18
6,397,648 B1 * 6/2002 Morris et al. ..... 70/423
6,408,661 B1 * 6/2002 Chen ..... 70/33
6,430,975 B1 * 8/2002 McDaid ..... 70/39
6,666,051 B1 * 12/2003 Li ..... 70/14
6,820,448 B1 * 11/2004 Hsieh ..... 70/18
6,898,952 B1 * 5/2005 Lin ..... 70/38 B
2002/0073747 A1 * 6/2002 Chen ..... 70/49
2003/0196462 A1 * 10/2003 Chen ..... 70/49

* cited by examiner

*Primary Examiner*—Lloyd A Gall
(74) *Attorney, Agent, or Firm*—Rosenberg, Klein & Lee

(57) ABSTRACT

A foldable lock structure includes an outer shell, an inner shell, a lock core, a lock case, a lock cover and a foldable lock rod set. The outer shell, the inner shell, and the lock core are all secured in the lock case and the lock cover. The lock core is secured in the inner shell. The lock case has a slidable anti-dust cover at the bottom thereof. The foldable lock set is connected to the outer shell and the lock cover in a rotatable manner.

5 Claims, 6 Drawing Sheets

FOLDABLE LOCK STRUCTURE

BACKGROUND OF THE INVENTION

1. Field of the Invention

The present invention relates to a foldable lock structure, and more particularly to a lock having an outer shell, an inner shell, a lock core, a lock case, a lock cover and a foldable lock rod set. The foldable lock rod set is formed with a number of rods connected with each other so as to secure an object.

2. Description of the Prior Art

A conventional lock device, as shown in FIG. 6, comprises a lock head A, a lock case B, a base C, and a lock rod set D. The lock head A is located in the lock case B. The lock case B comprises an anti-dust cover B2 which is rotatable with respect to the base C. The lock rod set D comprises a connecting rod D1, a linking rod D2 and an inserting rod D3. The lock rod set D is pivotally connected to the lock case B in a rotatable manner. By inserting a legal key into a key hole of a lock core B1 to activate a shaft A1, a sliding block A2 and a latch A3. The latch A3 is linked to insert into a through hole D31 of the insertion rod D3 from a fourth slot C1 of the base C to secure the lock rod set D.

SUMMARY OF THE INVENTION

This invention provides a foldable lock structure which simplifies the structure of the lock and provides an anti-dust cover.

According to the present invention, there is provided a foldable lock structure comprising an outer shell, said outer shell having a pivot seat, a first lock slot, and a bottom hole; an inner shell inserted in said outer shell, said inner shell comprising a trough, a lock hole corresponding in position to said bottom hole of said outer shell, a top hole interconnecting with said lock hole, a second lock slot next to said trough and corresponding in position to said first lock slot, and a latch disposed on said trough, said latch comprising a guiding groove and a protruding section; a lock core secured in said lock hole of said inner shell, said lock core comprising a key hole and a linking block, said linking block being provided with a linking plate having a pin, said pin of said linking plate being inserted through said top hole of said inner shell and engaging with said guiding groove of said latch; a lock case having an open end to sleeve on said outer shell, said lock case comprising a third lock slot corresponding in position to said first lock slot of said outer shell and a U-shaped trough at the bottom thereof, a graduation seat being provided at an inner edge of said U-shaped trough, said graduation seat having a lower surface and an upper surface, said open end of said lock case having a flange, said lock case further comprising an anti-dust cover to slide along said U-shaped trough to cover or to open said lock hole; a lock cover fitted on said flange of said lock case, said lock cover comprising a pivot cover on the top and a protruding plate extending from the bottom thereof, said protruding plate engaging with said lower surface of said U-shaped trough; and a foldable lock rod set pivotally connected to said outer shell and said lock cover, said foldable lock rod set comprising a connecting rod, a number of linking rods and an engaging rod, each of said connecting rod and said linking rods having holes at respective ends, said engaging rod having a hole at one end and an engaging hole at the other end, said connecting rod, said linking rods and said engaging rod being connected with fasteners.

Preferably, said protruding section of said latch is inserted into said engaging hole of said engaging rod to lock said foldable lock rod set.

Preferably, said fasteners of said foldable lock rod set are rivets.

Preferably, said lock case and said lock cover are glued together.

Preferably, one side of said second lock slot of said inner shell is formed with a recess for insertion of a guard plate.

The main object of the present invention is to provide a foldable lock structure, which is to simplify the parts and the structure.

BRIEF DESCRIPTION OF THE INVENTION

DETAILED DESCRIPTION OF THE PREFERRED EMBODIMENT

Figure 1:
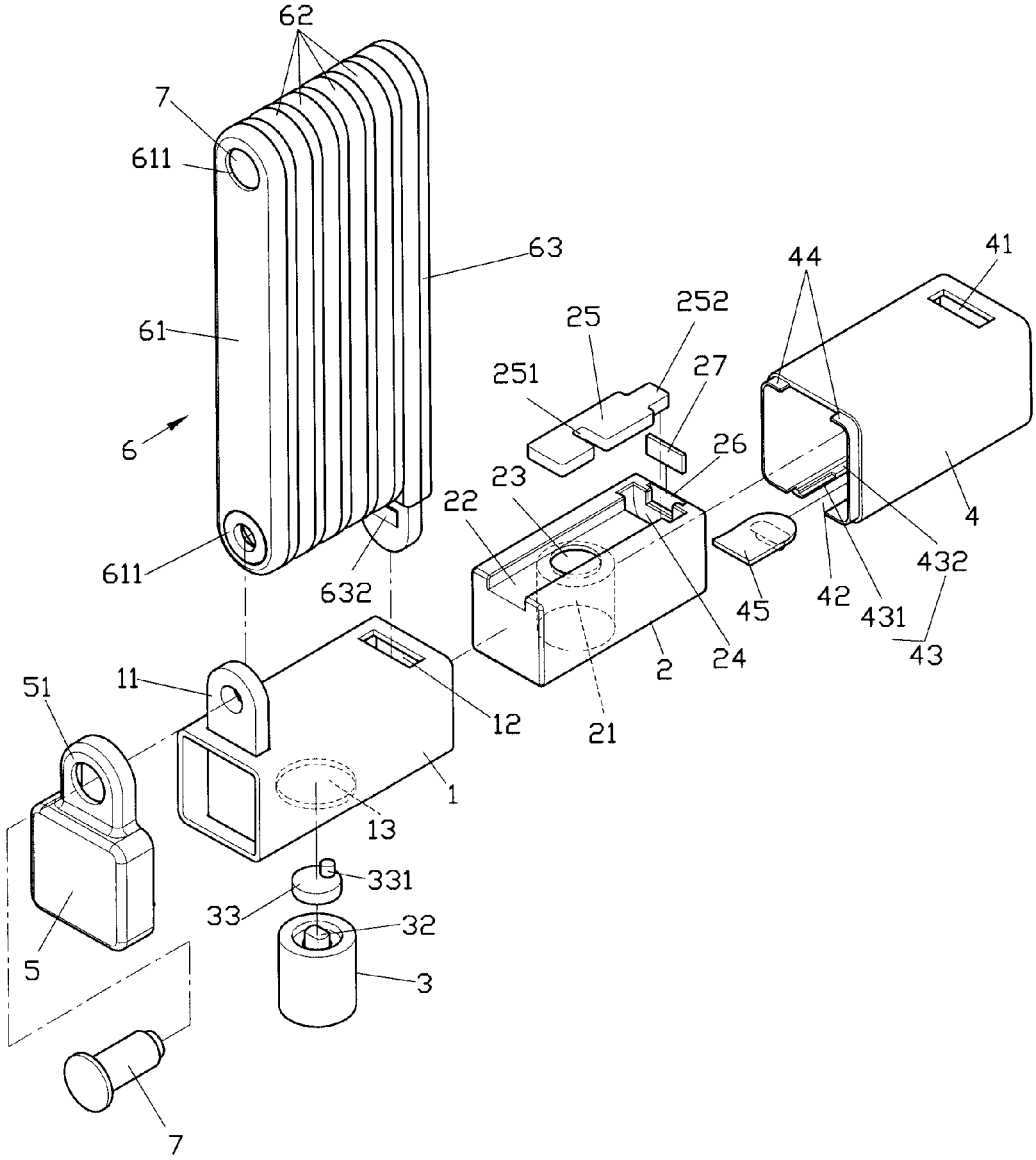
FIG. 1 is an exploded top view of the present invention.
Figure 2:
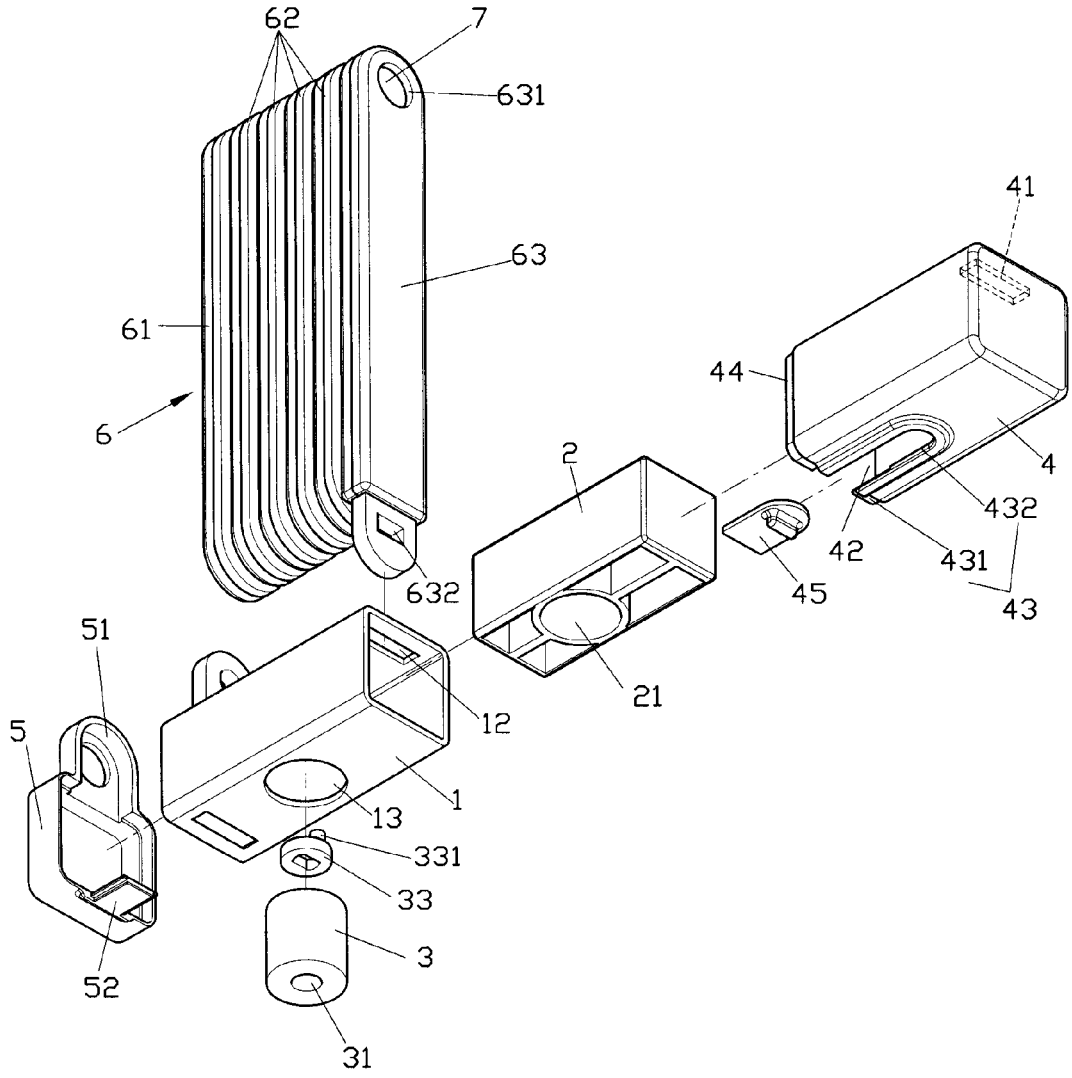
FIG. 2 is another exploded view of the present invention.

As shown in FIGS. 1 and 2, a preferred embodiment of the present invention comprises an outer shell 1, an inner shell 2, a lock core 3, a lock case 4, a lock cover 5, and a foldable lock rod set 6.

The outer shell 1 comprises a pivot seat 11, a first lock slot 12, and a bottom hole 13.

The inner shell 2 is mounted in the outer shell 1, and comprises a lock hole 21 corresponding in position to the bottom hole 13 of the outer shell 1, a trough 22 on top thereof, a top hole 23 interconnecting with the lock hole 21, a second lock slot 24 corresponding in position to the first lock slot 12, and a latch 25 adapted to slide along the trough 22. The latch 25 comprises a guiding groove 251 and a protruding section 252. One side of the second lock slot 24 is provided with a recess 26 for insertion of a guard plate 27.

The lock core 3 is secured in the lock hole 21 and comprises a key hole 31 and a linking block 32 which is connected to a linking plate 33 with a pin 331 thereat. The pin 331 of the linking plate 33 is inserted through the top hole 23 of the inner shell 2 and into the guiding groove 251 of the latch 25.

The lock case 4 is fitted on the outer shell 1 and has an open end. The lock case 4 has a third lock slot 41 corresponding in position to the first lock slot 12 and a U-shaped trough 42 at the bottom of the lock case 4. A graduation seat 43 is provided at an inner edge of the U-shaped trough 42. The graduation seat 43 has a lower surface 431 and an upper surface 432. The open end of the lock case 4 has a flange 44. The lock case 4 further comprises an anti-dust cover 45 which is coupled to the U-shaped trough 42 and is slidable along the upper surface 432 of the graduation seat 43 to cover or to open the key hole 31.

The lock cover 5 is fitted on the flange 44 of the lock case 4 and comprises a pivot cover 51 corresponding in position to the pivot seat 11 of the outer shell 1 and a protruding plate 52 extending from the bottom of the lock cover 5. The protruding plate 52 is adapted to engage with the lower surface 431 of the lock case 4 when the lock cover 5 is fitted on the flange 44.

The foldable lock rod set 6 is pivotally connected to the outer shell 1 and the lock cover 5, respectively. The foldable lock rod set 6 comprises a connecting rod 61, a number of linking rods 62, and an engaging rod 63. The connecting rod 61 and the linking rods 62 has holes 611 and 621 at respective ends, please refer to FIGS. 3 and 4. The engaging rod 63 has a hole 631 at one end and an engaging hole 632 at the other end thereof. The connecting rod 61, the linking rods 62 and the engaging rod 63 are all connected with fasteners 7. In this embodiment, the fasteners 7 are rivets.

The foldable lock rod set 6 is locked by insertion of the protruding section 252 of the latch 25 into the engaging hole 632 of the engaging rod 63.

The lock case 4 and the lock cover 5 are glued together. All of the parts, except the foldable lock rod set 6, are securely enclosed in the lock case 4 and the lock cover 5, which provides a safe and dust-proof lock device.

Figure 3:
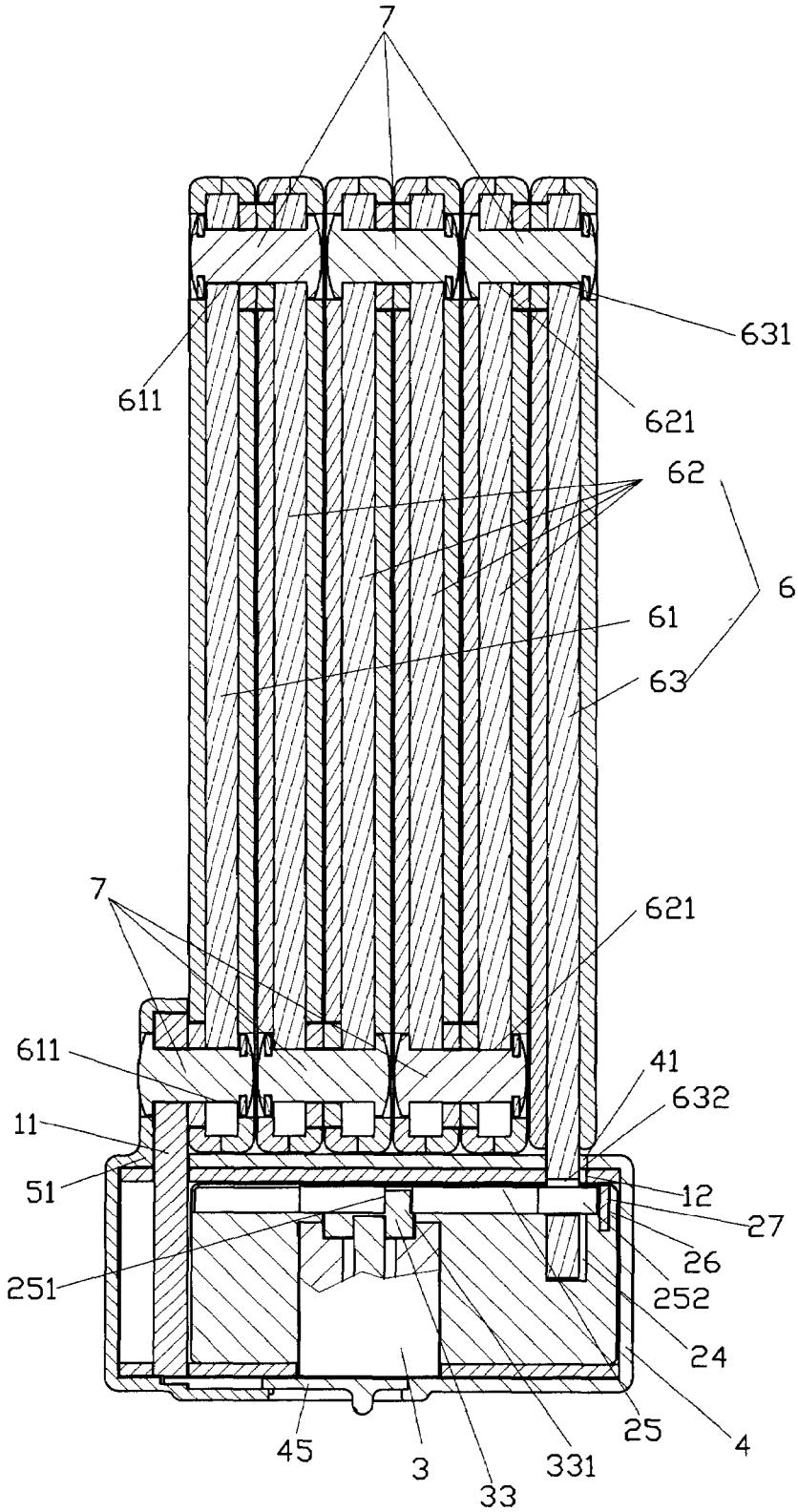
FIG. 3 is a cross-sectional view of the present invention showing a latch and an engaging hole in a locked position.

As shown in FIG. 3, the anti-dust cover 45 is in a closed status, and the pin 331 of the linking plate 33 is inserted into the guiding groove 251 of the latch 25. The engaging hole 632 of the engaging rod 63 is inserted through the third lock slot 41, the first lock slot 12 and the second lock slot 24 sequentially. The protruding section 252 of the latch 25 is at the most right position and engages with the engaging hole 632 of the engaging rod 63 so that the foldable lock rod set 6 is in a locked position.

The connecting rod 61, the linking rods 62 and the engaging rod 63 are connected by means of the fasteners 7 inserting through the holes 611, 621 and 631 so that each linking rod 62 is able to rotate respectively. The connecting rod 61 of the foldable lock rod set 6 is connected to the pivot seat 11 and the pivot cover 51, and then to the linking rods 62 and at last to the engaging rod 63. The guard plate 27 of the inner shell 2 is to prevent the lock from being breached by tool with force illegally.

Figure 4:
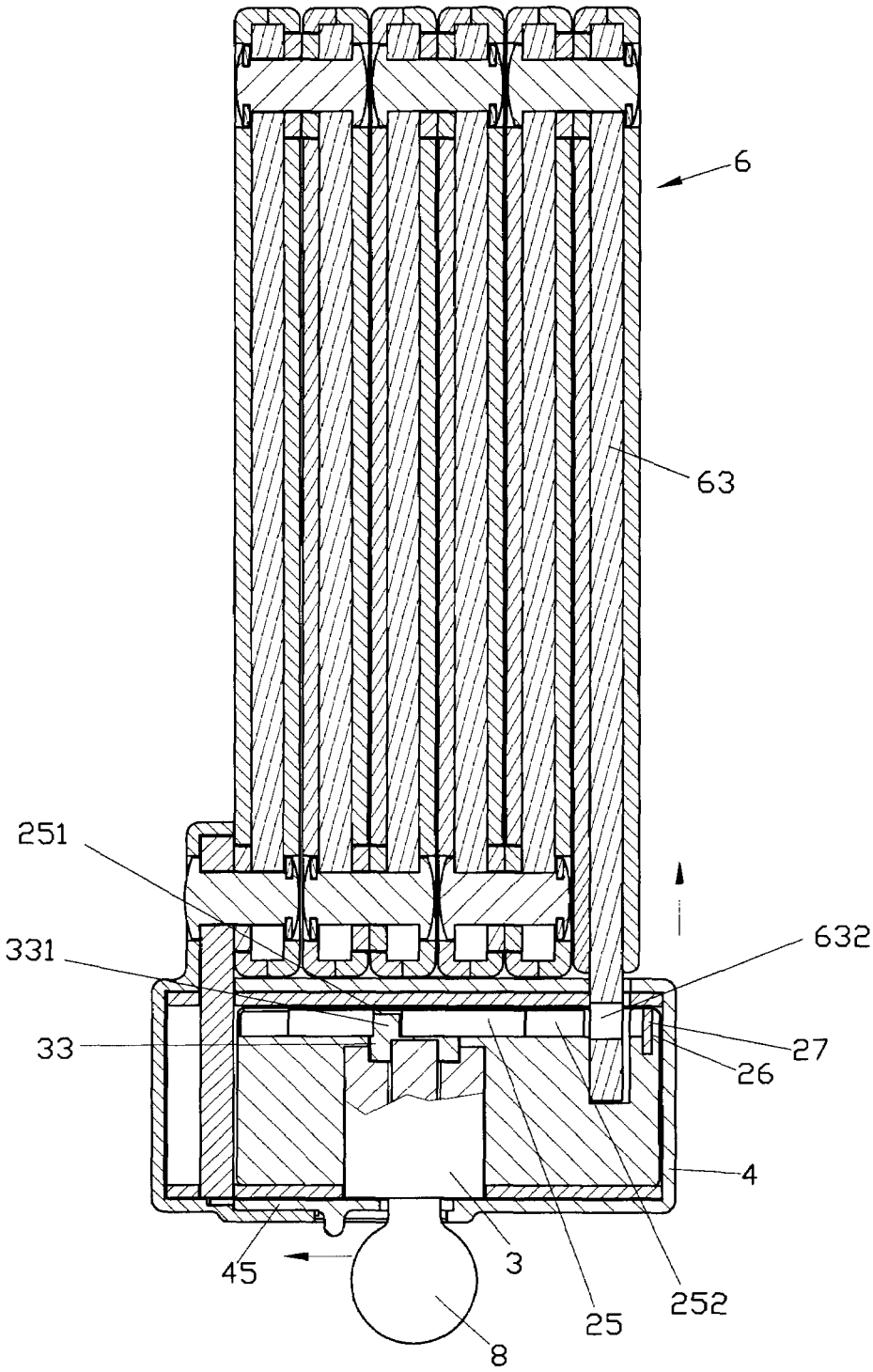
FIG. 4 is a cross-sectional view of the present invention showing the latch and the engaging hole in an unlocked position.

When the anti-dust cover 45 is in an open status, as shown in FIG. 4, a legal key 8 is inserted into the lock core 3 to drive the linking plate 33 to spin, which brings the pin 331 to link the latch 25 to slide. The protruding section 252 of the latch 25 retreats to the most left position so that the protruding section 252 is detached from the engaging hole 632 of the engaging rod 63. The foldable lock rod set 6 is free to move.

Figure 5:
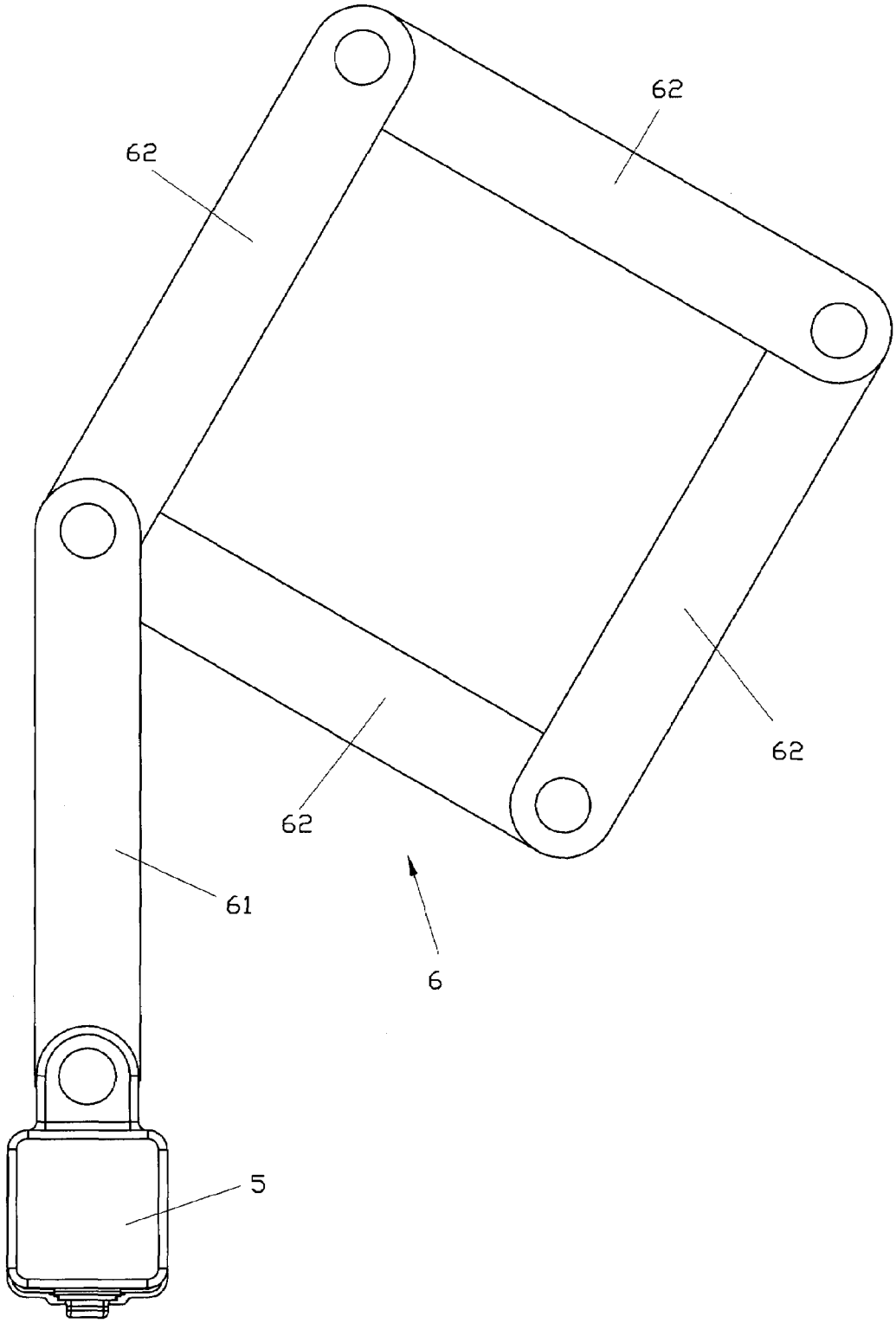
FIG. 5 is a perspective view of a foldable lock set in an open status.
Figure 6:
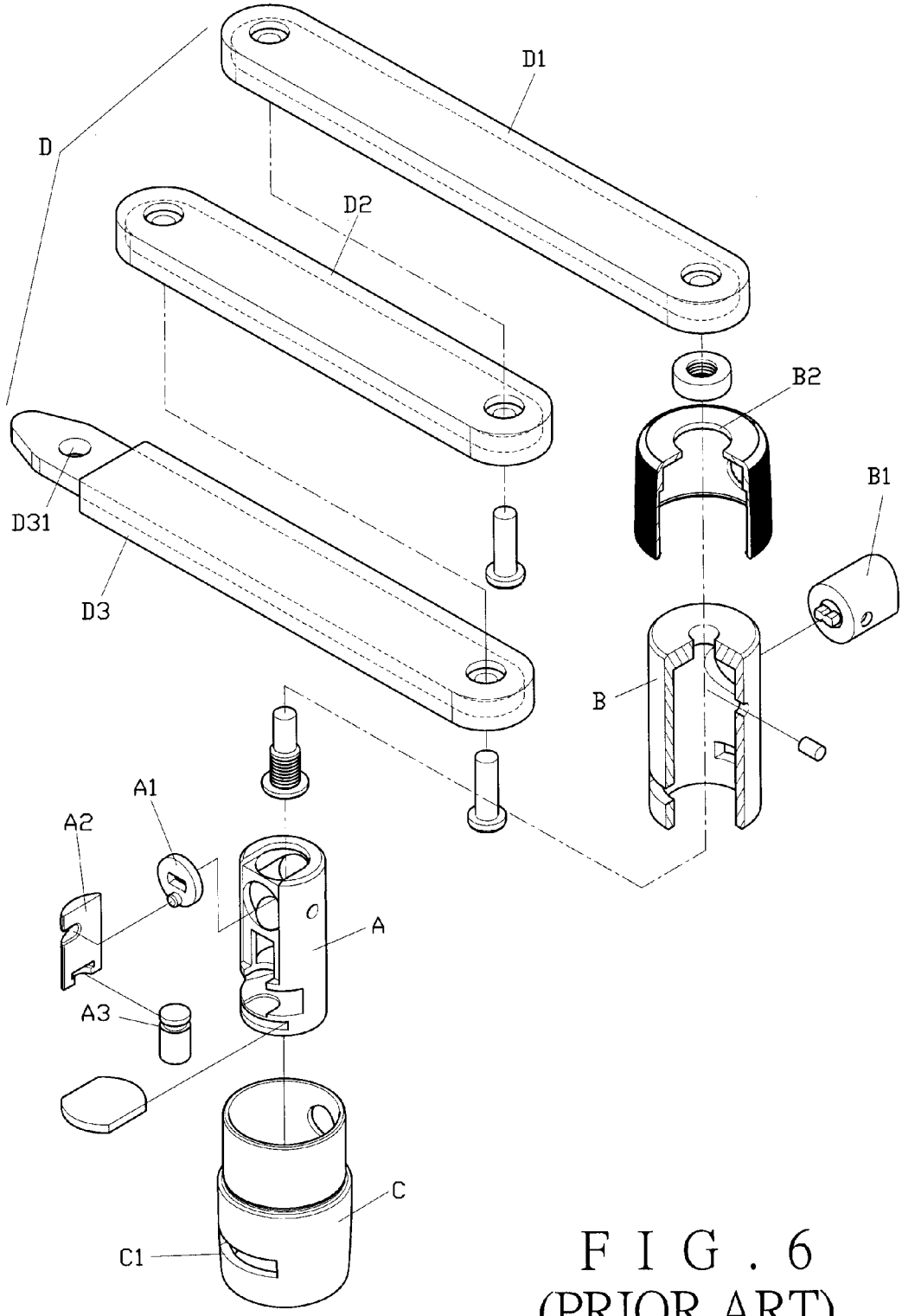
F I G . 6 (PRIOR ART)
FIG. 6 is an exploded view of the prior art.

To expand the foldable lock rod set 6, as shown in FIG. 5, the engaging rod 63 of the foldable lock rod set 6 remains in a vertical angle with respect to the lock case 4, while the connecting rod 61 and the linking rods 62 may be rotated to adjust to a desired angle.

The foldable lock structure of the present invention, in accordance with the above description, wherein the outer shell 1, the inner shell 2, the lock core 3, the lock case 4, and the lock cover 5 are all wrapped in a limited space. The inner shell 2 includes the lock core 3, the lock case 4 has the anti-dust cover 45 which is slidable with respect to the lock core 3, and the foldable lock rod set 6 is pivotally connected to the outer shell 1 and the lock cover 5, respectively.

What is claimed is:

1. A foldable lock structure comprising:

an outer shell, said outer shell having a pivot seat, a first lock slot, and a bottom hole;

an inner shell inserted in said outer shell, said inner shell comprising a trough, a lock hole corresponding in position to said bottom hole of said outer shell, a top hole interconnecting with said lock hole, a second lock slot next to said trough and corresponding in position to said first lock slot, and a latch disposed on said trough, said latch comprising a guiding groove and a protruding section;

a lock core secured in said lock hole of said inner shell, said lock core comprising a key hole and a linking block, said linking block being provided with a linking plate having a pin, said pin of said linking plate being inserted through said top hole of said inner shell and engaging with said guiding groove of said latch;

a lock case having an open end to sleeve on said outer shell, said lock case comprising a third lock slot corresponding in position to said first lock slot of said outer shell and a U-shaped trough at the bottom thereof, a graduation seat being provided at an inner edge of said U-shaped trough, said graduation seat having a lower surface and an upper surface, said open end of said lock case having a flange, said lock case further comprising an anti-dust cover to slide along said U-shaped trough to cover or to open said lock hole;

a lock cover fitted on said flange of said lock case, said lock cover comprising a pivot cover on the top and a protruding plate extending from the bottom thereof, said protruding plate engaging with said lower surface of said U-shaped trough; and a foldable lock rod set pivotally connected to said outer shell and said lock cover, said foldable lock rod set comprising a connecting rod, a number of linking rods and an engaging rod, each of said connecting rod and said linking rods having holes at respective ends, said engaging rod having a hole at one end and an engaging hole at the other end, said connecting rod, said linking rods and said engaging rod being connected with fasteners.

2. The foldable lock structure, as recited in claim 1, wherein said protruding section of said latch is inserted into said engaging hole of said engaging rod to lock said foldable lock rod set.

3. The foldable lock structure, as recited in claim 1, wherein said fasteners of said foldable lock rod set are rivets.

4. The foldable lock structure, as recited in claim 1, wherein said lock case and said lock cover are glued together.

5. The foldable lock structure, as recited in claim 1, wherein one side of said second lock slot of said inner shell is formed with a recess for insertion of a guard plate.

* * * * *